US012577736B2

(12) United States Patent
Coots

(10) Patent No.: US 12,577,736 B2
(45) Date of Patent: Mar. 17, 2026

(54) TIE PLATE COLLECTION AND DEPOSIT MACHINE

(71) Applicant: B & B Metals, Inc., Shepherdsville, KY (US)

(72) Inventor: Coty T. Coots, Shepherdsville, KY (US)

(73) Assignee: B & B Metals, Inc., Shepherdsville, KY (US)

( * ) Notice: Subject to any disclaimer, the term of this patent is extended or adjusted under 35 U.S.C. 154(b) by 712 days.

(21) Appl. No.: 17/937,645

(22) Filed: Oct. 3, 2022

(65) Prior Publication Data

US 2023/0112557 A1 Apr. 13, 2023

Related U.S. Application Data

(60) Provisional application No. 63/253,379, filed on Oct. 7, 2021.

(51) Int. Cl.
*E01B 29/32* (2006.01)

(52) U.S. Cl.
CPC ..... *E01B 29/32* (2013.01)

(58) Field of Classification Search
CPC ..... E01B 29/32
See application file for complete search history.

(56) References Cited

U.S. PATENT DOCUMENTS 6,807,909 B1 10/2004 Coots
7,406,919 B2 8/2008 Coots
7,827,916 B2 11/2010 Coots
8,166,883 B1 5/2012 Coots
8,316,774 B1 11/2012 Coots
8,393,846 B1 3/2013 Coots
8,443,733 B2 5/2013 Coots
8,459,924 B1 6/2013 Coots
8,636,460 B1 1/2014 Coots
9,016,208 B2 4/2015 Coots
9,038,542 B2 5/2015 Coots
9,328,465 B1 5/2016 Coots
9,422,673 B2 8/2016 Coots
9,446,662 B2 9/2016 Coots
9,745,132 B2 8/2017 Coots
9,745,150 B2 8/2017 Coots
9,752,286 B2 9/2017 Coots
10,094,071 B2 10/2018 Coots
10,112,215 B1 10/2018 Coots
(Continued)

FOREIGN PATENT DOCUMENTS

CA 2565458 A1 5/2007
CA 2644242 A1 5/2009
(Continued)

OTHER PUBLICATIONS

Canadian Patent Office; Application Serial No. 3178139, filed Sep. 30, 2022.

(Continued)

*Primary Examiner* — Robert J McCarry, Jr.
(74) *Attorney, Agent, or Firm* — Dinsmore & Shohl LLP

(57) ABSTRACT

A tie plate collection and deposit machine collects tie plates from a railway and sorts the tie plates sequentially. The sorted tie plates are then deposited on the railway for re-installation during the maintenance procedure being performed.

18 Claims, 9 Drawing Sheets

(56) References Cited

U.S. PATENT DOCUMENTS

| | | | | |
|---|---|---|---|---|
| 10,316,471 | B2 | 6/2019 | Coots | |
| 10,329,100 | B1 | 6/2019 | Coots | |
| 10,427,876 | B2 | 10/2019 | Coots | |
| 10,745,208 | B1 | 8/2020 | Coots | |
| 10,865,527 | B2 | 12/2020 | Coots | |
| 11,136,726 | B1 * | 10/2021 | Coots | E01B 29/24 |
| 11,299,859 | B2 | 4/2022 | Coots | |
| 11,427,408 | B2 | 8/2022 | Coots | |
| 2020/0407923 | A1 | 12/2020 | Coots, III et al. | |
| 2021/0404122 | A1 | 12/2021 | Coots | |
| 2022/0010499 | A1 | 1/2022 | Coots | |
| 2022/0176409 | A1 | 6/2022 | Coots | |
| 2022/0213653 | A1 | 7/2022 | Coots | |

FOREIGN PATENT DOCUMENTS

| | | | |
|---|---|---|---|
| CA | 2468106 | A1 | 6/2009 |
| CA | 2810688 | A1 | 9/2013 |
| CA | 2814607 | A1 | 4/2014 |
| CA | 2843094 | A1 | 8/2014 |
| CA | 3024667 | A1 | 5/2019 |
| CA | 3046462 | | 12/2019 |
| CA | 3060645 | | 5/2020 |
| CA | 3085102 | | 12/2020 |
| CA | 3122444 | A1 | 12/2021 |
| CA | 3122448 | A1 | 12/2021 |
| CA | 3140766 | | 6/2022 |

OTHER PUBLICATIONS

United States Patent Office, U.S. Appl. No. 17/729,612, filed Apr. 26, 2022.

United States Patent Office, U.S. Appl. No. 17/895,592, filed Aug. 25, 2022.

Canadian Patent Office, Application serial No. 3156342, filed Apr. 19, 2022.

* cited by examiner

TIE PLATE COLLECTION AND DEPOSIT MACHINE

CLAIM TO PRIORITY

This non-provisional patent application claims priority to and benefit of, under 35 U.S.C. § 119(e), U.S. Provisional Patent Application Ser. No. 63/253,379, filed Oct. 7, 2021 and titled "Tie Plate Collection and Deposit Machine", all of which is incorporated by reference herein.

BACKGROUND

1. Field of the Invention

Present embodiments related to a tie plate collection and deposit machine. More specifically, but without limitation, present embodiments relate to a device which collects tie plates during a railroad maintenance procedure, and which sorts and orients the tie plates for depositing on or around the railroad track for further reinstallation.

2. Description of the Related Art

In some railroad maintenance procedures, when tie plates are collected they are discarded in favor of new tie plates. However, many of these tie plates are capable of reuse and accordingly many railroad operators have an increasing desire to better utilize resources. One manner in which this is possible is the reuse of tie plates.

It would therefore be desirable to provide a machine which picks up tie plates that are disconnected along a railway, and sorts them for re-distribution in a sorted and sequential manner along the railway.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

Present embodiments relate to a machine that retrieves tie plates from a railway. The tie plates are sorted by determining and correcting, if necessary, lateral orientation and/or vertical orientation. The tie plates are then sequentially loaded on to distribution conveyors which return the sorted tie plates to the railway for subsequent installation.

According to some embodiments, a tie plate collection and deposit machine may comprise a first collection conveyor having a magnetic pulley and a belt, a work table having at least two conveyors which are arranged for movement in a direction transverse to the first collection conveyor, a tie plate orientation station, having a rotatable structure to rotate tie plates and/or flip the orientation of the tie plates depending on input from a sensor. At least one deposit conveyor may receive each of the tie plates from the tie plate orientation station and deposits each of the tie plates for re-use of the tie plates.

In some optional embodiments, the tie plate collection and deposit machine may further comprise a frame. The tie plate collection and deposit machine may further comprise rail wheels to support the frame on a railroad track. The first collection conveyor may be height adjustable.

The at least one deposit conveyor may be two deposit conveyors. The first collection conveyor may be disposed between the two deposit conveyors. The at least two conveyors may move the tie plates perpendicularly to a horizontal direction of the first collection conveyor. The work station table including one of the at least two conveyors having a substantially vertical surface and the other of the at least two conveyors having a substantially horizontal surface. The other of the at least two conveyors may be two conveyors.

In some embodiments, a work table for a tie plate collection and deposit machine may comprise at least one first conveyor which is substantially flat, at least one second conveyor which is oriented vertically and positioned adjacent to the at least one first conveyor, the at least one first conveyor and the at least one second conveyor receiving tie plates from a collection conveyor and rotating and translating each of the tie plates.

In some optional embodiments, the at least one first conveyor may be two conveyors operating in opposite directions. The at least one second conveyor being two conveyors operating in opposite directions. The two conveyors of the at least one second conveyor may operate in a same direction as an adjacent of the two conveyors of the at least one first conveyor.

In some embodiments, a tie plate orientation station comprises a sensor which determines vertical orientation and lateral orientation of a tie plate, a spider which is capable of rotating the tie plate to change the lateral orientation of the tie plate, a first door and a second door positioned beneath the spider, the first and second doors capable of opening together or individually to change the vertical orientation of the tie plate. The sensor being one of a distance, laser, optical, or ultrasonic. The sensor determining the lateral orientation of a high side or a low side leading. The sensor determining the vertical orientation of shoulder up or shoulder down. The tie plate orientation station further comprising a motor which rotates the spider. The tie plate orientation station, wherein one of the first door or the second door opens to change the vertical orientation. The tie plate orientation station wherein both of the first door and the second door open to maintain the vertical orientation.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a machine that retrieves tie plates from a railway will now be described by way of examples. These embodiments are not to limit the scope of the claims as other embodiments of a tie plate collection and deposit machine will become apparent to one having ordinary skill in the art upon reading the instant description. Non-limiting examples of the present embodiments are shown in figures wherein:

DETAILED DESCRIPTION

Figure 1:
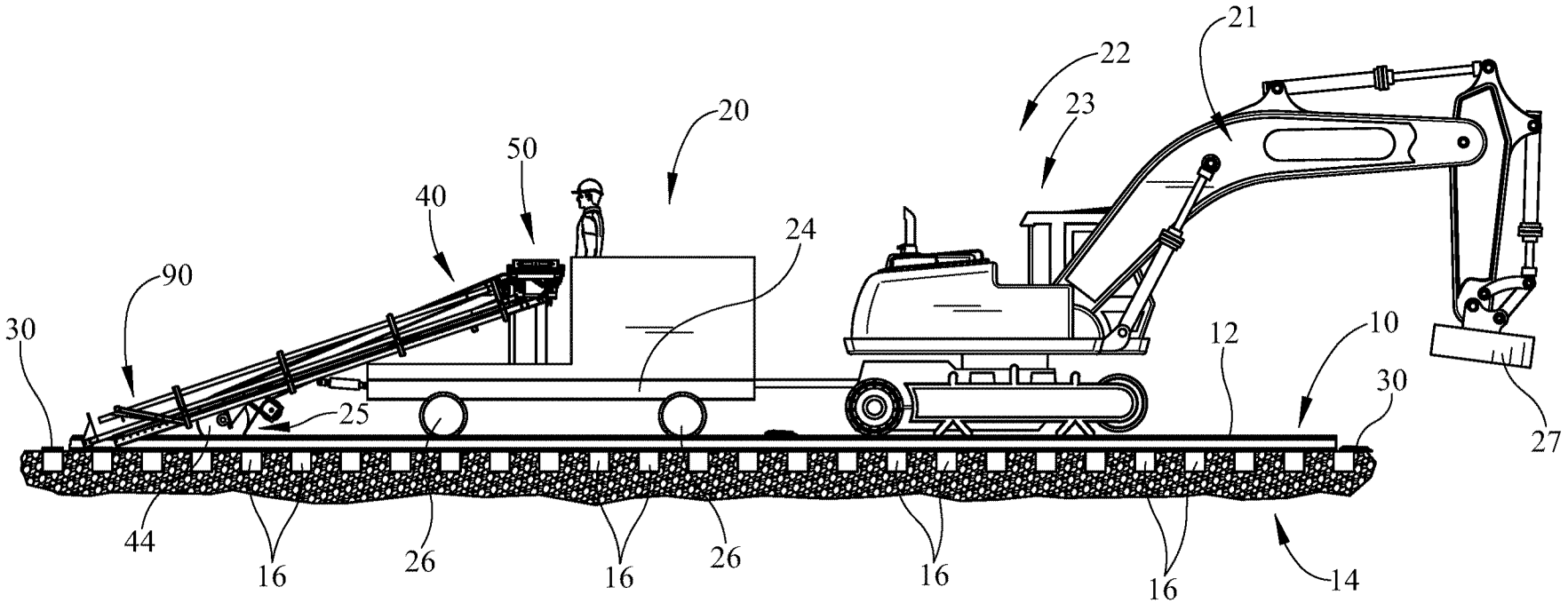
FIG. 1 is a side view of a tie plate collection and deposit machine.

It is to be understood that a tie plate collection and deposit machine is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

FIGS. 1-9 depicts embodiments of a machine which collect tie plates that are disposed along a railway, then sort, and re-distribute the tie plates along the railway. The machine utilized a conveyor with a magnetic device to retrieve tie plates along a railway. The tie plates are directed to a sorting station which orients the tie plates laterally and/or vertically in order to allow re-distribution of the tie plates in a manner for improved re-installation of the tie plates.

Referring now to FIG. 1, a side view of a tie plate collection and distribution machine 20 is provided. The tie plate collection and distribution machine 20 moves along a railway, or railroad track system 10, in order to provide for installation of the railroad. The tie plate collection and distribution machine 20 is in shown being pulled by a tow vehicle 22 for working during railroad maintenance.

Figure 3:
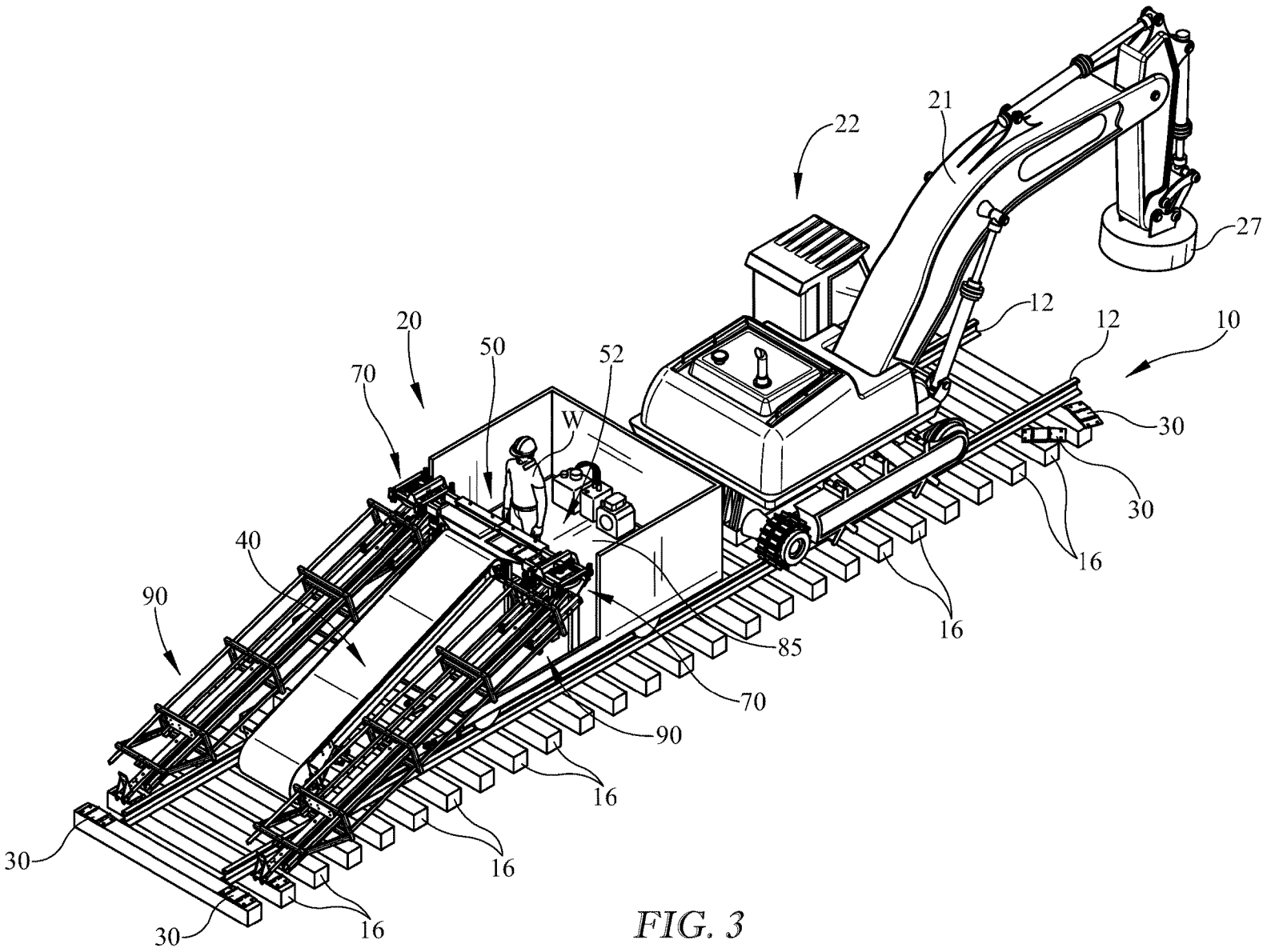
FIG. 3 is a perspective view of the machine of FIG. 1.

With regard to the railway 10, the collection machine 20 is shown located on a railroad track 12 of a railroad track system, or railway 10. Beneath the railroad track 12, a ballast 14 provides a substrate upon which a plurality of railroad ties 16 are disposed. The ballast 14 may be formed of rocks or other material which provides a stable base and allows for proper drainage. Further, the ballast 14 may have an upper elevation which raises the railway 10 to a height out of known flood plains. The railroad ties 16 are generally spaced apart equally some preselected distance, for example about 19.5 inches between ties 16. However, this spacing may vary from one railroad operator to another and should not be considered limiting. The railroad ties 16 are generally rectangular having a square cross-section. Disposed on an upper surface of each railroad tie 16 are a plurality of tie plates 30 (FIG. 3). The tie plates 30 are anchored to the railroad tie 16 and provide a place for positioning of the railroad track 12. Although a single track 12 is shown in the side view, one skilled in the art will understand that in some embodiments, two tracks, or rails, 12 are laid in parallel fashion and spaced apart at a preselected gauge distance providing the railroad track system. Also, in other embodiments, a single track may be utilized with a custom machine having supports of, for example, tracks or wheels on the side opposite the rail.

The machine 20 comprises a frame 24 and a plurality of rail wheels 26 which support the frame 24. The machine 20 is shown in a form which is pulled by another vehicle, the tow vehicle 22. In some embodiments, the tow vehicle 22 may be an excavator but in other embodiments the tow vehicle 22 may be other vehicles, such as a hi-rail vehicle capable of pulling the machine. Still further, in other embodiments, the machine 20 may be self-driven by including an engine or motor and a transmission, or other mechanical means for driving the machine 20.

In the depicted embodiment the tow vehicle 22, for example the excavator 23, may include a magnet 25 at the end of the boom 21. The magnet 25 may be used to pick up tie plates along the railway 10 which have been previously disconnected and are strewn about the area, either inside or outside the rails 12. The magnet 25 may be used to magnetically pick up one or more tie plates 30 at a time and move the tie plates to an area where the machine 20 can pick them up. In the depicted example, the machine 20 may pick up the tie plates 30 from between the rails 12, however, this is not limiting as the machine 20 may alternatively pick up the tie plates 30 from various locations.

The frame 24 supports a first collection conveyor belt 40 which picks up the tie plates 30 which are appropriately located by the boom 21 of the excavator 23. In some examples, the first collection conveyor 40 is located centrally located so that the tie plates 30 are picked up and disposed centrally between the rails 12 by the tow vehicle 22.

The first collection conveyor 40 may be formed of various types of conveying devices capable of moving the tie plates 30 from a lower elevation of the railway 10 to a higher elevation on the machine 20. For example, the first collection conveyor 40 may, in some non-limiting embodiments, be a belt conveyor 43 which has a magnetic lower pulley 44. The magnetic lower pulley 44 may magnetically pickup to the tie plates 30 so that they are frictionally retained on a belt 43. The belt 43 may or may not have cleats to aid in retention of the tie plates 30 on the belt 43. This may be helpful depending on the downward angle of the collection conveyor 40. While a conveyor belt 43 is shown, other embodiments may be utilized to pick up the tie plates 30.

The first collection conveyor 40 may be adjustable in height in order to pick up the lower end of the conveyor 40, for example if approaching a raised area at a railway crossing or other like area where the height of the lower pulley 44 needs varying. The adjustment may be by hydraulics, electric, or pneumatic to raise and lower all or some portion of the collection conveyor 40.

The first collection conveyor 40 delivers tie plates to a work station 50, which extends transverse to the collection conveyor 40. The work station 50 receives the tie plates 30 from the first collection conveyor 40 directs the tie plates 30 to either of two orientation stations 70. At the work station 50 or the orientation station 70, the orientation of the tie plates 30, both laterally and vertically, are determined. As will be discussed further herein, tie plates 30 may be unsymmetrical having a longer side relative to an adjacent shoulder (the high side) and a shorter side relative to another adjacent shoulder (the low side). This refers to which side—the high side or the low side—is leading along the conveyor. Likewise, the vertical orientation refers to whether the tie plate is oriented in a shoulder up or shoulder down orientation.

Once an orientation determination is performed by a sensor 68 (FIG. 7) and processing system, the tie plate 30 may be oriented at an orientation station in a desired manner for subsequent distribution back to the railway 10. The machine 20 may have one or more orientation stations 70 and in the example embodiment may include two orientation stations 70, each of which receive tie plates 30, make determination of an orientation of each tie plate and subsequently re-orient each tie plate 30, if needed.

The machine 20 may have one or more distribution systems 90 which receive the properly oriented tie plates 30 and move the tie plates 30 back down to the railway 10 for subsequent installation on the railroad ties 16.

Figure 2:
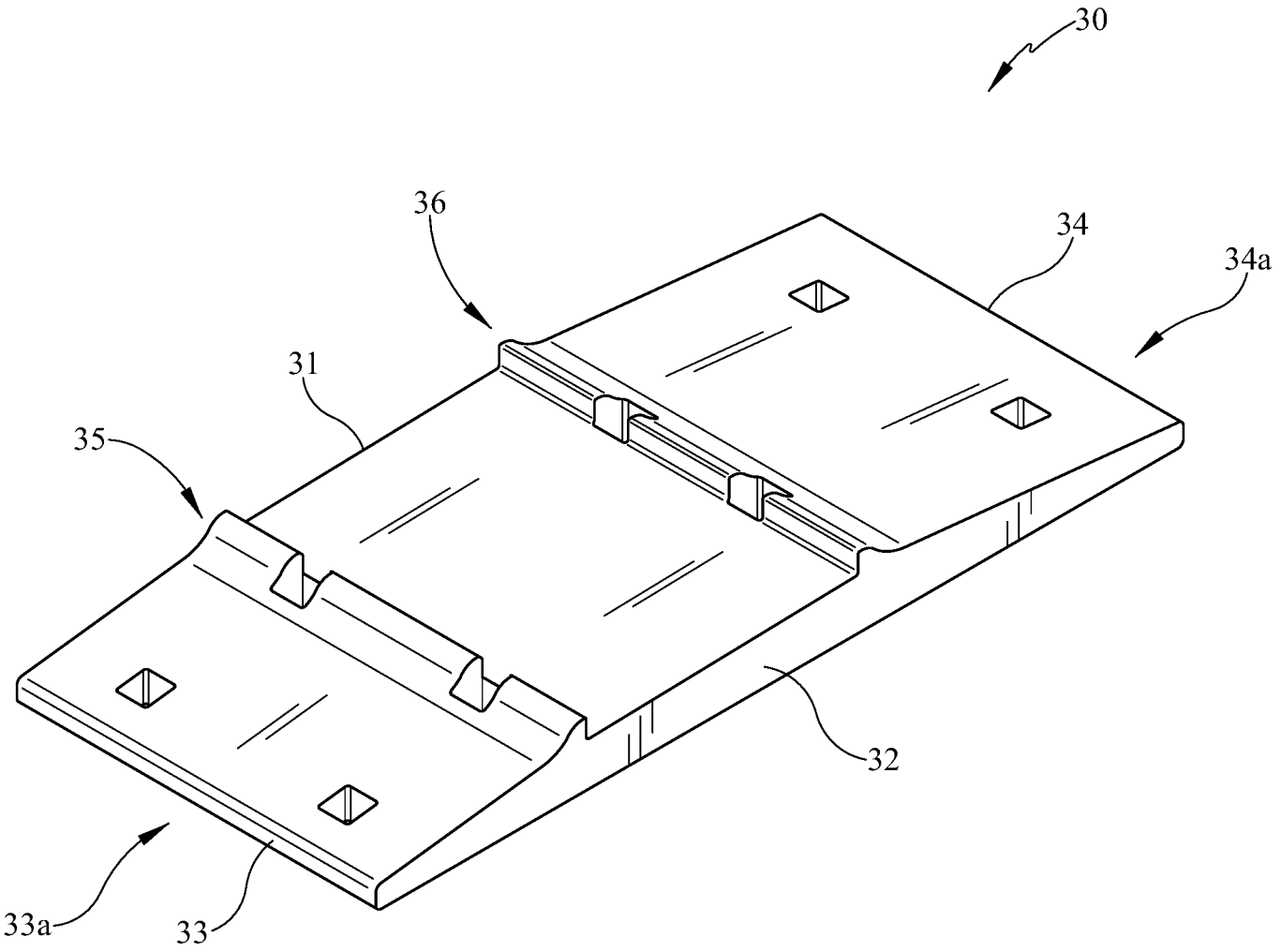
FIG. 2 is a perspective view of a tie plate.

Referring now to FIG. 2, a perspective view of a tie plate 30 is depicted. The tie plate 30 is generally rectangular in shape having two long edges 31, 32 and two lateral edges 33, 34.

The tie plate 30 also has a first shoulder 35 and a second shoulder 36. In some embodiments, the tie plate 30 may have a single shoulder. In either or other embodiments, the tie plate rotation is desirable for the plates which are not symmetrical with regard to the shoulder(s). In the instant embodiment, the first shoulder 35 is closer to the lateral side 33*a* than the second shoulder 36 is to the adjacent lateral side 34*a*. The side 34*a* with the longer dimension between shoulder 36 and edge 34 is called the high or field side 34*a* and the side 33*a* with the shorter dimension between the shoulder 35 and the edge 34 is called the low or gauge side 33*a*. According to some embodiments, the field side 34*a* and gauge side 33*a* may be of equal length and if all other factors are the same, then the tie plate 30 may be centered about a center line extending through the tie plate 30 in either the long or the short direction. However, some tie plates may have only a single shoulder and other tie plates may have two shoulders, as depicted, wherein the shoulders 35, 36 are not equilaterally positioned relative to the adjacent lateral sides. Thus, the tie plate 30 may be oriented in a manner which is desirable and it may be important to determine the orientation of the tie plate 30 prior to or during the distribution process.

According to instant embodiments, it may be desirable to adjust the lateral orientation of the tie plate 30. That is, orient the tie plate 30 with either the high side 34*a* leading along a conveyor of the work station 50 or the low side 33*a* leading along a conveyor of the work station 50. Additionally, the tie plate 30 may be adjusted in vertical orientation. That is, the orientation of the shoulders 35, 36 up or shoulders 35, 36 down.

Referring now to FIG. 3, a perspective view of the machine 20 is depicted. As shown, the first collection conveyor 40 is centrally located. Laterally outward of the first collection conveyor 40 are the distribution or deposit conveyors 90. These deposit conveyors 90 provide tie plates 30 at two locations, one tie plate 30 corresponding to each of the rails 12 of the railway 10. The work station 50 includes a work table 52 which comprises conveyors moving the tie plates 30 from the first collection conveyor 40 to the distribution conveyors. The work table 52 moves the tie plates 30 in two directions, from the central location to the outer locations of the deposit conveyors 90. The work table 52 may have a single horizontal conveyor which changes direction or, as depicted may have two horizontal conveyors 54, 56 (FIG. 6) which feed in opposite directions.

Additionally, in this view, the orientation station 70 provides is shown. The orientation station 70 rotates and/or flips each tie plate 30 before the tie plate 30 is deposited on the deposit conveyor 90.

Also shown on the frame 24 is a control platform 85. The control platform 85 provides a location for a worker W and also may include utility systems 86. For example, the utility systems 86 may include a combustion powered generator 87, a hydraulic fluid power system 88, and/or a pneumatic system 89. The hydraulic system 88 may power the collection conveyor hydraulic motor 84 (FIG. 6) for example. The pneumatic system 89 may operate gates 77, 78 and a spider 72 (FIG. 8) in the orientation station 70 and electric may be used to power various features of the machine 20.

Figure 4:
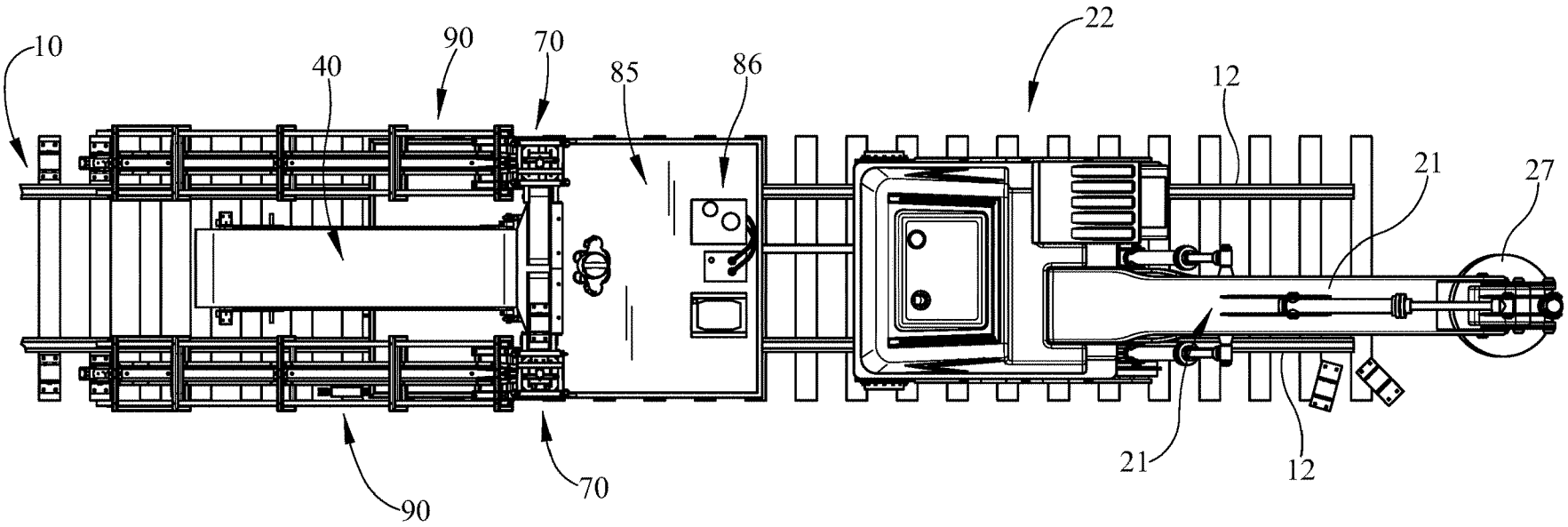
FIG. 4 is a top view of the machine of FIG. 1.

With reference now to FIG. 4, the top view shows the tow vehicle 22 and the machine 20. The boom 21 of the excavator 23 comprises the magnet 27 and in the depicted view retains tie plates 30 from the exterior of the rails 12, and moves them to a location between the rails 12. This positions the tie plates 30 in alignment with the collection conveyor 40 for magnetic pick up. In this example, the collection conveyor 40 is centrally located, but other locations may be utilized.

Figure 5:
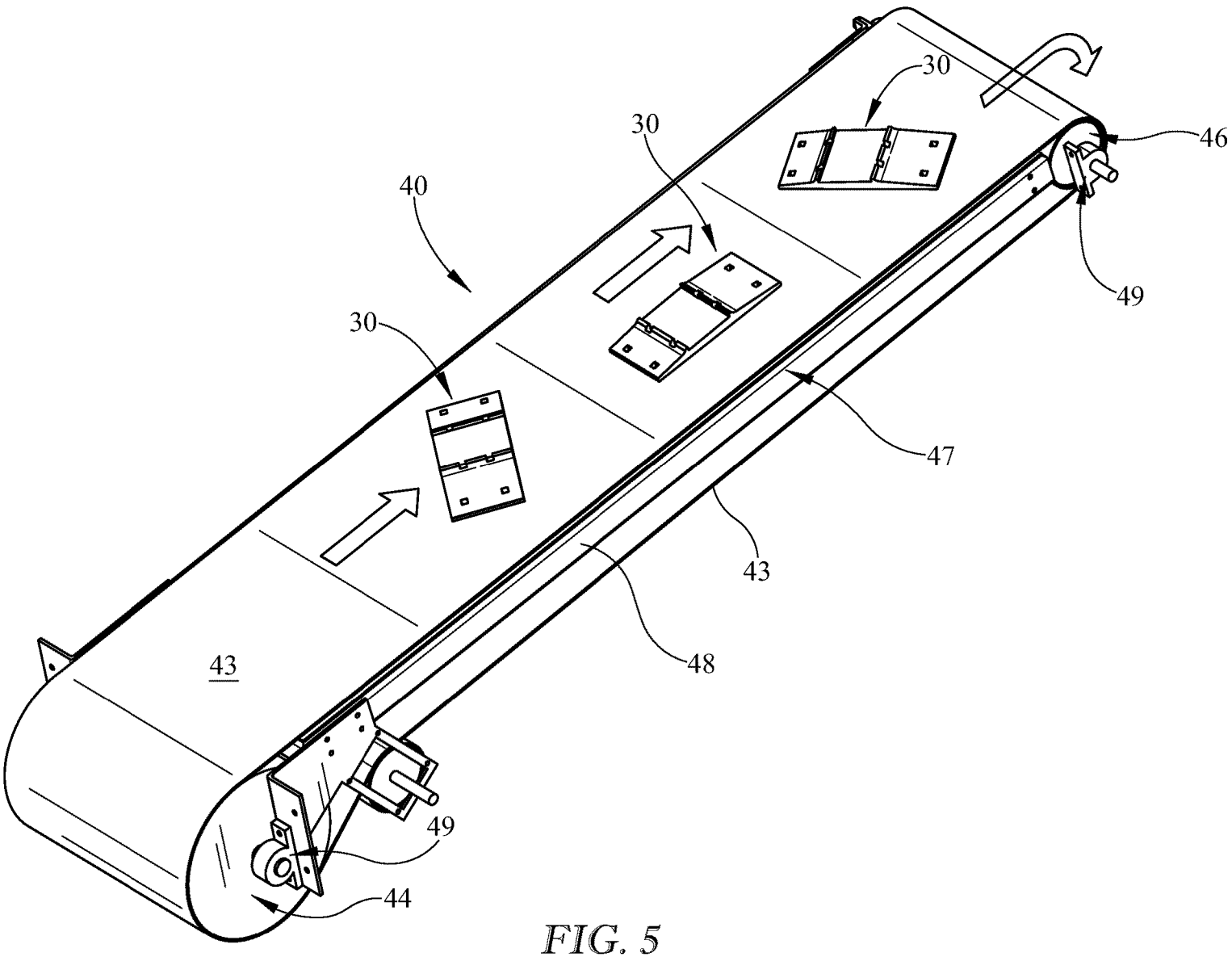
FIG. 5 is a perspective view of the first collection conveyor.

With reference to FIG. 5, a perspective view of the collection conveyor 40 is depicted. The conveyor 40 comprises a first pulley 46 and a second pulley 44 wherein one of the pulleys is a head pulley 46. The head pulley 46 may be driven directly by a motor, for example an electric or hydraulic motor and may further comprise a transmission, and the second pulley 44 may be tail pulley. In the instant embodiment, since the conveyor is driven upwardly the head pulley 46 is at the upper end of the collection conveyor 40. The collection conveyor 40 may comprise a belt 43 as well. The belt 43 may extend between the first and second pulleys 46, 44 and rotates to move the tie plates 30 up in elevation.

Additionally, in some embodiments, the lower pulley 44 may be magnetized. This may be a permanent magnetization or it may be electrically controlled, to turn on or off the magnetization. In operation, as the first pulley (head pulley) 46 and the belt 43 rotate, this causes rotation of the lower pulley 44. In the instant embodiment, for example, the lower pulley 44 is magnetized and therefore picks up the tie plates 30 moved to the middle of the railway 10 by the magnet 27 of the excavator boom 21. Accordingly, the lower tail pulley 44 picks up the tie plates 30 and the tie plates 30 either frictionally engage, or mechanically engage, or both, so that the tie plates 30 are moved up in elevation along the collection conveyor 40.

Also shown in this view, a frame 47 is formed of one or more conveyor frame elements 48. The frame elements 48 may include a mount structure for the pulley bearings of the first and second pulleys 46, 44. Further, the collection conveyor 40 may additionally include a hydraulic, electric, or pneumatic actuator to raise or lower the collection conveyor 40. Bearings 49 may be mounted on or around the frame 47 in order to rotatably support the belt pulleys 46, 44.

Figure 6:
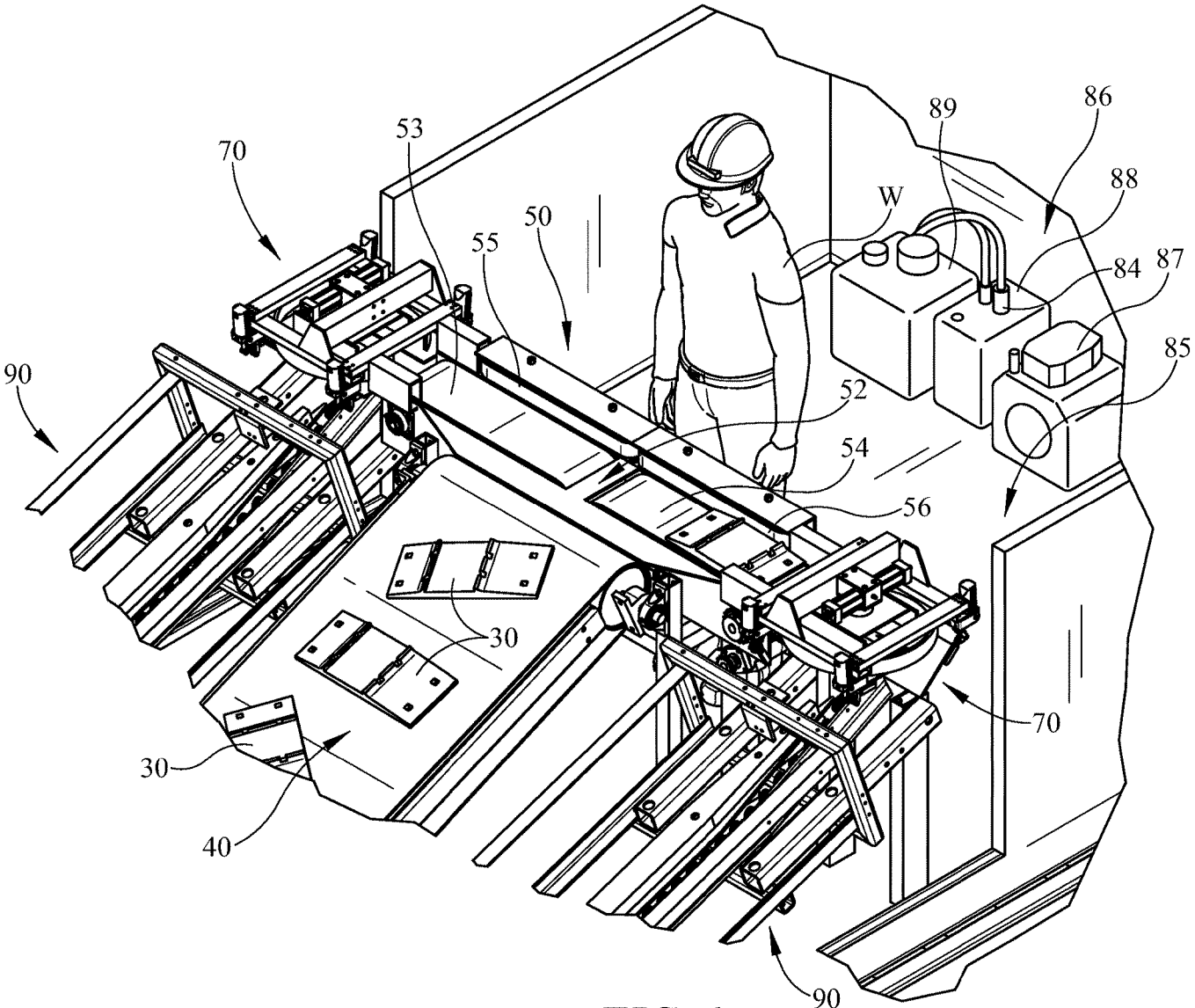
FIG. 6 is a perspective view of the work station including the work table.

Referring to FIG. 6, a perspective view of the work station is depicted. The work station 50 receives tie plates 30 from the collection conveyor 40 and provides a location where the tie plates may be sorted by worker W. The worker W may manually, or with the aid of a device, move the tie plates 30 from the collection conveyor 40 in one direction or another of the work station 50 so that the tie plates 30 feed toward the orientation stations 70 and subsequently feed both of the distribution conveyors 90.

The work station 50 comprises a work table 52 which is a flat surface upon which the tie plates 30 are delivered from the collection conveyor 40. The work table 52 may comprise a movable surface, a fixed surface, or both. The work table 52 may comprise at least one conveyor which may reversible in operation to send tie plates in either direction toward the orientation stations. In the depicted embodiment, the at least one conveyor in the work station comprises a first conveyor 53 and a second conveyor 54 which operate to move the tie plates 30 in opposite directions. The work station conveyors 53, 54 may operate continuously or may operate intermittently.

The work station 50 also comprises at least one vertically oriented conveyor. The vertically oriented conveyor is positioned adjacent to the at least one horizontal belt of the work station. In some embodiments, the vertical conveyor is embodied by a first vertical conveyor 55 and a second vertical conveyor 56. The vertical conveyors 55, 56 are oriented so that surfaces of the conveyors 55, 56 are disposed in a generally vertical plane. The two adjacent conveyors 53, 55 are substantially perpendicular to one another and the other two conveyors 54, 56 are also substantially perpendicular to one another. The two vertical conveyors 55, 56 each rotate in a direction corresponding to the adjacent horizontal conveyor belt 53, 54, respectively. In this way, each pair of adjacent conveyors 53, 55 and 54, 56 can function to orient a tie plate 30 for further feeding since the tie plates 30 may not be organized on the collection conveyor 40.

Each pair of a horizontal conveyor and a vertical conveyor engage the tie plates 30 feeding from the collection conveyor and rotate the tie plates about a vertical axis into a desired orientation for further work at the orientation stations 70. The tie plates 30 rotate into an orientation such that the longitudinal edges are directed toward the orientation stations 70, as depicted. From this position, the lateral orientation of the tie plates 30 may be determined—that is, determination of whether the high side or the low side is leading in the movement direction of the tie plate.

Figure 7:
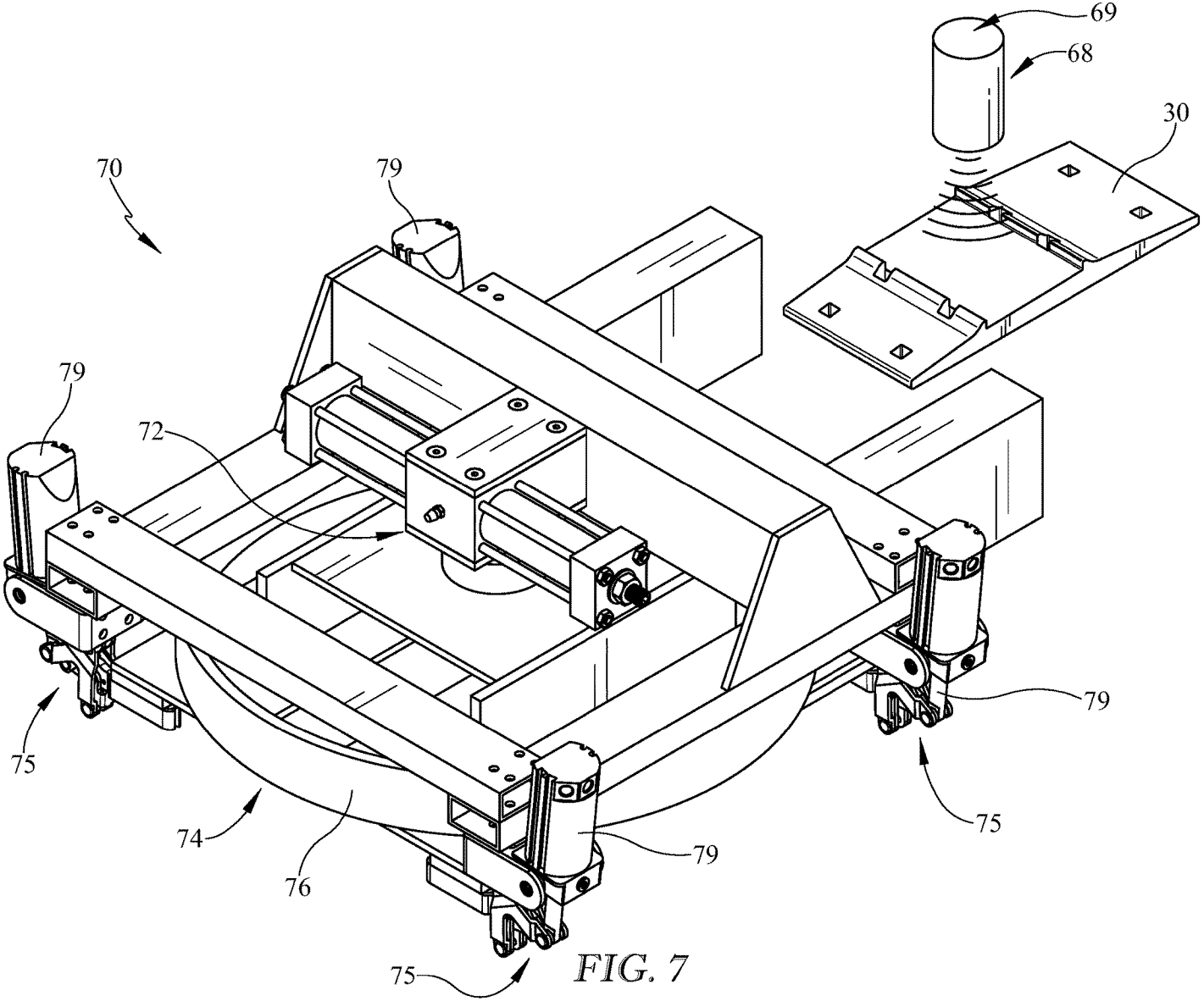
FIG. 7 is a first perspective view of the orientation station.
Figure 8:
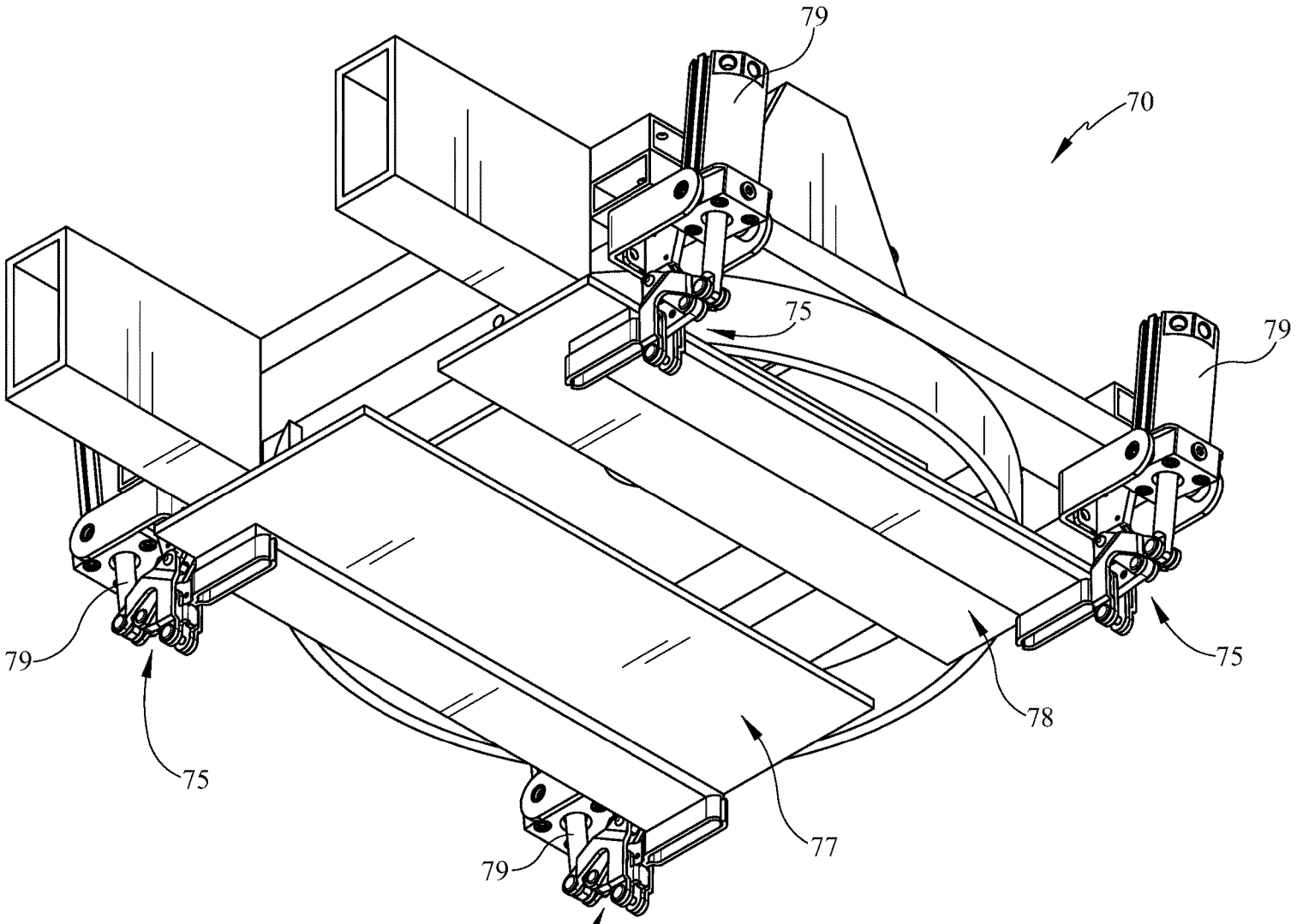
FIG. 8 is a second perspective view of the orientation station.

Referring to FIGS. 7 and 8, upper and lower perspective views are shown respectively, depicting the orientation station 70 of the tie plate collection and distribution machine 20. The tie plate orientation station 70 receives tie plates 30 from the work station 50 and first makes a determination, or receives information of the determination, from the at least one sensor 68. The at least one sensor 68, in combination with a processor 69, makes a determination of the lateral orientation of the tie plate 30 and the vertical orientation of the tie plate 30. That is, the determination of whether the high side or low side of the tie plate 30 is leading travel direction into the spider 72 and a determination of whether the shoulders 35, 36 of the tie plate 30 are up or down (upright or upside down). When this determination is made by the at least one sensor 68, the orientation station 70 will then allow the tie plate 30 to pass as is, make an adjustment of the lateral orientation, make an adjustment of the vertical orientation, or some combination of adjustments.

Each of the tie plate orientation station 70 includes a platter 74 which receives that tie plate 30 and utilizes a spider to engage the tie plate that is received on the platter 74 comprising a surrounding wall 76. Once the tie plate 30 is in position on the platter 74, and a determination has been made that an adjustment is needed, the spider 72 can rotate and, via the engagement with the tie plate 30, thereby rotate the tie plate 30 about a vertical axis. The rotation may occur by a motor or actuator which causes rotation of the spider 72 and therefore also causes rotation of the tie plate 30 about the vertical axis. This rotation about a vertical axis will change the lateral orientation of the tie plate 30, if necessary.

The tie plate orientation station 70 also comprises first and second gates 77,78 which define a support surface of the platter 74. The gates 77, 78 define a floor of the orientation station 70 and may be utilized to drop the tie plates 30 on to the next processing area of the machine 20. The gates 77, 78 also provide function to adjust the vertical orientation of the tie plates 30. For example, if the tie plate 30 is upside down, the tie plate 30 may be flipped during discharge by the gates 77, 78 in order to change the vertical orientation from upside down to right side up. Alternatively, if the tie plates 30 are right side up in the orientation station 70 and the railroad operator requests that the tie plates 30 be discharged in an upside-down configuration, the tie plates 30 may be accordingly adjusted in the vertical orientation in this same manner.

The gates 77, 78 may comprise a first door and a second door which differ in size such that one of the doors is larger than the other. In operation, when a tie plate 30 received by the orientation station 70 is in a correct orientation, either without adjustment or with lateral orientation adjustment, both of the doors will open to allow the tie plate 30 to fall to a processing area following the orientation station 70. Alternatively, if the tie plate 30 in the orientation station 70 requires vertical adjustment, one of the doors is actuated to open which causes the tie plate to flip during its discharge. Thus, the vertical orientation of the tie plate 30 is adjusted as the tie plate 30 moves out of the orientation station 70 to a next processing area of the machine 20.

Each gate 77, 78 is shown having at least one actuator 79 and a linkage assembly 75 which connects the door to the actuator. The instant embodiment utilizes two actuators for each door and a linkage assembly 75 which includes a bar that connects the doors to the linkage assembly 75. With actuation of the at least one actuator 79, the gates 77, 78 are moved either individually in order to change the vertical orientation of the tie plate 30 or alternatively simultaneously, to drop the tie plate 30 in an unchanged orientation.

Figure 9:
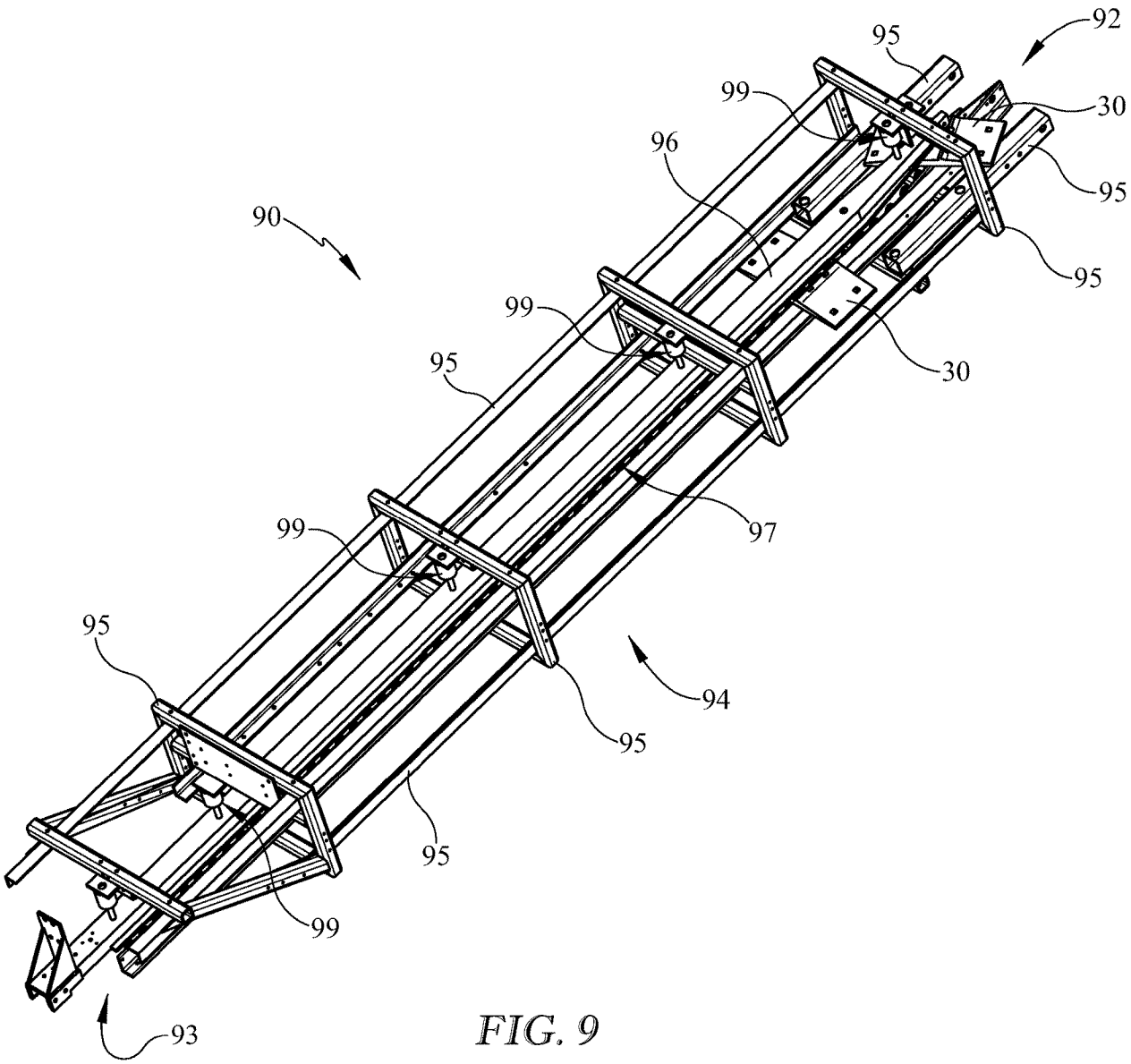
FIG. 9 is a perspective view of one of the distribution conveyors.

Referring now to FIG. 9, a perspective view of one of the distribution, or deposit, conveyors 90 is depicted. The distribution conveyor 90 receives tie plates 30 from the orientation station 70 and guides the tie plates 30 downwardly from an upper elevation of the work station 50 to the railway 10. Each distribution conveyor 90 comprises a first, upper input end 92 of a diagonally downwardly and rearwardly sloping gravity feed, conveyor to an output end 93. The slope of the conveyor 90 may be suitable at about 10 to 40 degrees from horizontal, and in some embodiments, 20 to 30 degrees, however other ranges may be utilized.

The conveyor 90 may include a conveyor frame 94 defined by one or more frame structural elements 95 which support a plurality of rollers, blocked in this view. The frame 94 may define a longitudinal direction of the conveyor, and the frame elements may extend in the longitudinal direction of the conveyor 90 or may be perpendicular.

The conveyor 90 may comprise a series of parallel and closely spaced apart cylindrically or circularly shaped rollers 97 which are freely rotatable about their longitudinal axes, as for example, on conventional bearings. The rotational axes of each roller 97 extends in a direction that is perpendicular to the longitudinal axis of the conveyor 90. The tops of the rollers 97 define a conveying surface, which support the tie plates 30. The rollers 97 are suitably journaled in opposing and parallel extending side beams or rails of the conveyor frame 94. While the instant embodiment shows generally flat plate structures, other structures may be used, for non-limiting example channel, angle iron shapes, or box/rectangular shapes may be used to define the frame elements 95 and support the rollers 97. Additionally, these or other structures may be joined, for example by welding, or by additional structures in order to define a one-piece frame.

The conveyor 90 may be defined by other structures as well. In one alternative, an inclined chute with a metal base could be utilized as the conveyor 90 provided it is operatively inclined at a sufficient angle to assure that the tie plates 30 placed on an upper input end thereof will readily slide downwardly along the base and subsequent release to the railway. The angle of incline in such a chute may need to be greater than that of the conveyor 90. In other embodiments the conveyor 90 may be embodied by a vibratory feeder instead of the rollers or the chute. As used herein, the term conveyor may include, but is not limited to, any of these examples of structures which move tie plates 30—roller conveyor, powered conveyor, belt conveyor, chute, vibratory feeder, combinations of any of these or other structure which generally move a part from a first position to a second position, or the like.

Tie plates 30 may be discharged in a plurality of ways. In some embodiments, the tie plates 30 may be held magnetically at the end of overhead guide 96, until discharged from a magnet at the end of the distribution conveyors 90. The tie plates 30 freely gravitates off of a lower output end 93 of the conveyor 90 for disposition along the railway 10 in any of the previously discussed arrangements for disposal. Accordingly, once the apparatus 90 is indexed so as to drop one of the tie plates 30, either on one of the ties 16, or mid-way between two adjacent ties, or at or near ends of the railroad ties 16. One skilled in the art will realize that the dropping of tie plates 30 may be indexed relative to the distance traveled by the tie plate dispenser or distributor 20.

Disposed above the rollers 97 may be a guide 96. The guide 96 is a longitudinally extending structure or combination of structures that extends in the direction of the tie plate movement along the conveyor 90. The guide 96 is disposed above the rollers 97 so that the tie plates 30 are supported by the rollers 97 and the guide 96 locates the tie plates on the rollers 97 and guides the tie plates 30 down the conveyor 90 on the rollers 97. The guide 96 is depicted as flat stock in some embodiments, but may be other structural shapes as well. For example, the guide 96 may also be embodied by the flat stock or may further comprise a beam to which the flat stock is connected, wherein the beam may be connected to the frame or frame elements. Additionally, the guide 96 may be adjustable in order to move the guide up and down relative to the rollers 97, and allow for varying sizes of tie plates 30.

At an upper end of the guide 96, the guide 96 may be tapered from a narrow width. The first end of guide 96 at the input end 92 provides a narrow width in order to increase the likelihood of positioning the first guide end between the shoulders 35, 36 of each tie plate 30. As shown, the tie plate 30 located at the narrow end is out of alignment relative to the direction of movement. However, the guide 96 will correct the skewed tie plate 30 as it moves along the tie plate conveyor 90.

Referring still to FIG. 9, the tie plates may be enter the dispenser 20 askew. When this occurs, the narrow first, upper guide end still engages the tie plate 30 (nearest first end 92) between the tie plate shoulders 35, 36. Briefly, the tie plates 30 may be of varying sizes and varying shapes. Many tie plates 30 are rectangular in shape as illustrated and may comprise two shoulders 35, 36 (FIG. 2) are extending from the upper surface of the tie plate. According to some examples, the shoulders provide a locating and alignment feature for positioning of a railroad track 12 in order to connect the track or rail to the railroad tie 16 (FIG. 1). Some tie plates 30 may have a single shoulder while some may have two, as depicted. The number is not to be considered limiting, however, the guide 96 may use at least one, or two, shoulder in order to align the tie plates 30, rather than the outer edges of the tie plates. By relying on the outer edges, the positioning and alignment is then partially dependent on outer dimensions, and therefore alignment may vary where batches of multiple sized tie plates are utilized. Thus where two shoulders are used, the alignment may be independent of tie plate dimension and use of multiple sizes of tie plates may not affect the operation. In some other embodiments however, it may be desirable to use a guide which functions from the perimeter edges or dimensions of the tie plates 30, rather than the shoulders. This may be, for example, where the tie plates are all known to be of a single size.

As the guide 96 widens from the first end 92 to its full width, the tie plate 30 will rotate to it proper alignment and position on the conveyor. The rotation is due to engagement between the shoulders 35, 36 (FIG. 2) and guide 96. Further, the guide 96 retains the tie plate 30 in desired position laterally along the conveyor 90, while the tie plate 30 continues moving longitudinally along the conveyor 90. It should be understood that some tolerance is necessary to allow for movement of the tie plates 30, rather than stoppage, during use of the distribution conveyor 90.

The guide 96 may be supported in a number of ways. According to some embodiments, the guide 96 is supported from above by the supports or by the frame elements 95. In such a way, the guide is disposed at a height or gap above the conveying surface. This defines a gap defined between the rollers and the guide 96, wherein the tie plate may be disposed and move through toward the toward the output end 93 of the distribution conveyor 90. The gap is sized so that the guide is positioned between the shoulders of a tie plate and at a height so not to stop movement of the tie plate therebetween. As one skilled in the art will understand, the tie plates 30 may be formed in differing sizes and accordingly, may have heights or thicknesses which differ. For example, some tie plates may have a thickness of up to ¾ of an inch while other size tie plates may have a thickness of about ⅞ of an inch. These dimensions are merely examples and others may be utilized, and therefore should not be considered limiting.

The guide 96 may also be adjustably supported so that the height of the guide may be changed relative to the conveying surface below. Therefore, the adjustability of the guide in a height or vertical dimension may allow for appropriate clearance of tie plates of differing sizes which improves usage of the dispenser 20. For example, a guide actuator 99 may be mounted to each of the supports in order to move the guide 96 vertically and vary the height relative to the conveying surface. The one or more actuators 99 may be supported at various locations along the conveyor path for raising and lowering the guide. The guide actuator 99 may be fixed to a frame member, structure, or other support of the dispenser 20 and may have a piston or other movable structure which connects to the guide. In this way, the movement of the piston in a vertical direction will move the guide vertically. The guide actuator 99 may be electrical, hydraulic, pneumatic, combinations, or other movable structures such as a manually actuable structure—for example a threaded rod and locking nuts. Likewise, the guide actuator 99 may have a motor for example which rotates to cause linear motion of an actuation element alternative to typical to a piston.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of." "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A tie plate collection and deposit machine, comprising:

a first collection conveyor having a magnetic pulley and a belt;

a work table having at least two conveyors which are arranged for movement in a direction transverse to said first collection conveyor, a first conveyor of said at least two conveyors having a flat horizontal surface and a second conveyor of said at least two conveyors having a substantially vertical surface and positioned adjacent to said first conveyor of said at least two conveyors, said at least two conveyors receiving tie plates from said first collection conveyor and rotating and translating each of said tie plates;

a tie plate orientation station, having a rotatable structure to rotate said tie plates and/or flip orientation of the tie plates depending on input from a sensor;

at least one deposit conveyor which receives each of said tie plates from said tie plate orientation station and deposits each of said tie plates for re-use of said tie plates.

2. The tie plate collection and deposit machine of claim 1, further comprising a frame.

3. The tie plate collection and deposit machine of claim 2 further comprising rail wheels to support said frame on a railroad track.

4. The tie plate collection and deposit machine of claim 2, said first collection conveyor being height adjustable.

5. The tie plate collection and deposit machine of claim 1, wherein said at least one deposit conveyor is two deposit conveyors.

6. The tie plate collection and deposit machine of claim 5, wherein said first collection conveyor is disposed between said two deposit conveyors.

7. The tie plate collection and deposit machine of claim 1, wherein said at least two conveyors of said work table move said tie plates perpendicularly to a horizontal direction of said first collection conveyor.

8. The tie plate collection and deposit machine of claim 1, said other of said at least two conveyors being two conveyors.

9. A work table for a tie plate collection and deposit machine, comprising:

at least one first conveyor which is substantially flat;

at least one second conveyor which is oriented vertically and positioned adjacent to said at least one first conveyor;

said at least one first conveyor and said at least one second conveyor receiving tie plates from a collection conveyor and rotating and translating each of said tie plates;

said at least one first conveyor being two conveyors operating in opposite directions.

10. The work table for a tie plate collection and deposit machine of claim 9, said at least one second conveyor being two conveyors operating in opposite directions.

11. The work table for a tie plate collection and deposit machine of claim 10, said two conveyors of said at least one second conveyor operating in a same direction as an adjacent of said two conveyors of said at least one first conveyor.

12. A tie plate orientation station, comprising:

a sensor which is utilized to determine vertical orientation and lateral orientation of a tie plate;

a spider which is capable of rotating said tie plate to change the lateral orientation of the tie plate;

a first door and a second door positioned beneath said spider, said first and second doors capable of opening together or individually to change the vertical orientation of said tie plate.

13. The tie plate orientation station of claim 12, said sensor being one of a distance, laser, optical, or ultrasonic.

14. The tie plate orientation station of claim 12, said sensor determining said lateral orientation of a high side or a low side leading.

15. The tie plate orientation station of claim 14, said sensor determining said vertical orientation of shoulder up or shoulder down.

16. The tie plate orientation station of claim 12, further comprising a motor which rotates said spider.

17. The tie plate orientation station of claim 12 wherein one of said first door or said second door opens to change said vertical orientation.

18. The tie plate orientation station of claim 12 wherein both of said first door and said second door open to maintain said vertical orientation.

* * * * *